US005860762A

United States Patent [19]

Nelson

[11] Patent Number: 5,860,762

[45] Date of Patent: Jan. 19, 1999

[54] ENERGY ABSORBING BARRIER SYSTEM

[76] Inventor: Charles B. Nelson, 152 Forest Ave., Lake Zurich, Ill. 60047-1331

[21] Appl. No.: 958,760

[22] Filed: Oct. 25, 1997

[51] Int. Cl.[6] ..... E01F 13/00; E04H 17/00; A01K 3/00

[52] U.S. Cl. ..... 404/6; 256/1; 256/13.1

[58] Field of Search ..... 404/6, 7, 8, 9, 404/10; 256/1, 13.1; 52/309.14, 309.17, 738.1, 405.1, 405.2, 592.6, 591.4

[56] References Cited

U.S. PATENT DOCUMENTS

| | | | |
|---|---|---|---|
| Re. 29,544 | 2/1978 | Fitch | 256/13.1 |
| 1,867,299 | 7/1932 | Armstrong | 52/405.2 X |
| 4,059,362 | 11/1977 | Smith | 404/6 |
| 4,086,015 | 4/1978 | Eliasson | 404/6 |
| 4,685,656 | 8/1987 | Lee et al. | 256/13.1 |
| 4,909,661 | 3/1990 | Ivey | 404/6 |
| 5,069,576 | 12/1991 | Pomero | 404/6 |
| 5,286,136 | 2/1994 | Mandish et al. | 404/6 |
| 5,360,286 | 11/1994 | Russell | 404/6 X |
| 5,387,049 | 2/1995 | Duckett | 404/6 |
| 5,531,540 | 7/1996 | Wasserstrom et al. | 256/13.1 X |
| 5,605,413 | 2/1997 | Brown | 404/6 |
| 5,746,537 | 5/1998 | Kellas et al. | 404/6 |

FOREIGN PATENT DOCUMENTS

| | | | |
|---|---|---|---|
| 2457928 | 1/1981 | France | 404/6 |
| 294101 | 4/1965 | Netherlands | 52/591.4 |

*Primary Examiner*—Tamara L. Graysay
*Assistant Examiner*—Sunil Singh
*Attorney, Agent, or Firm*—James P. Hanrath

[57] ABSTRACT

An energy absorbing barrier system comprises a plurality of composite concrete barriers, each barrier including a reinforced concrete section having a back wall upon a support base. The support base is connected to a concrete veneer face section having an upper portion and a lower portion. The face section forwardly slopes from the support base to form an obtuse angle therewith such that the upper portion of the face section extends at least partially over the lower portion of the face section. The back wall and the face section defines an intermediate center core section therebetween consisting of a light density crushable material. The connection of the concrete veneer face section to the support base has a sheer point that facilitates the collapsing in of the face into the intermediate core section.

12 Claims, 3 Drawing Sheets

ENERGY ABSORBING BARRIER SYSTEM

BACKGROUND

1. Field of Invention

This invention relates to traffic barriers, specifically to energy absorbing barriers used in auto racing, oval, street and road tracks.

2. Description of Prior Art

Traditionally, auto racing tracks require a barrier to define the track and separate spectators from the cars participating in the event. In the past, hay bales, dirt berms, wood railings, tires, blocks of polystyrene, and steel guard rails all have been tried, at one time or another, to retain and decelerate a high speed vehicle within the confines of a racing circuit. Steel guard railings in particular worked about the best from the preceding group, but failed in several areas.

(a) In a high speed impact the railing would self-destruct as part of the energy absorbing capability, in a manor requiring a lengthy time to repair, thus causing a delay of an event.

(b) As railings were being destroyed, parts could come loose and act as deadly missiles possibly injuring participants or spectators.

(c) The railings were generally destructive to the offending vehicle.

(d) use as a barrier in a temporary street circuit situation, the cost of erection and tear down are totally prohibitive.

The partial solution was to pour concrete walls in place or to haul in precast units to define the racing circuit. These type of barriers work well in retaining the vehicle on the track, but the drawback is a barrier that has little or no energy absorbing capability; thus having the possibility of seriously injuring the driver or damaging the car.

OBJECTS AND ADVANTAGES

Accordingly, several objects and advantages of a energy absorbing barrier system are:

(a) To provide a barrier that will absorb much of the crash impact thus reducing possible injury or death to the occupants.

(b) To provide a barrier that will spread the crash impact across an increasingly larger area in relationship to the kinetic energy potential.

(c) To provide a barrier that has the ability to take a substantial parallel impact without having the need to fix or replace.

(d) To provide a barrier that can aid in debris retention due to the forward sloping face.

(e) To provide a barrier that can decrease the sound level emanating from the race track.

(f) To provide a barrier with a simple and flexible system of use.

(g) To provide a barrier system that has turning capability without having openings in between units or having the need for a hinge type mechanism.

(h) To provide a barrier system that can be easily repaired by replacement of standard length units.

(i) To provide a barrier system whose units can be repaired off site.

Further objects and advantages are to provide a barrier system of units that will negate the use of a backer, such as soil, or the need to pin the units down, that will be unaffected by weather, that can be easily moved by a forklift truck, which can be mated to other styles of barrier walls, which can be used repeatedly, which will present a superior surface for advertising. Still further objects and advantages will become apparent from a consideration of the ensuing description and drawings.

Reference Numerals in Drawings

Figure 1:
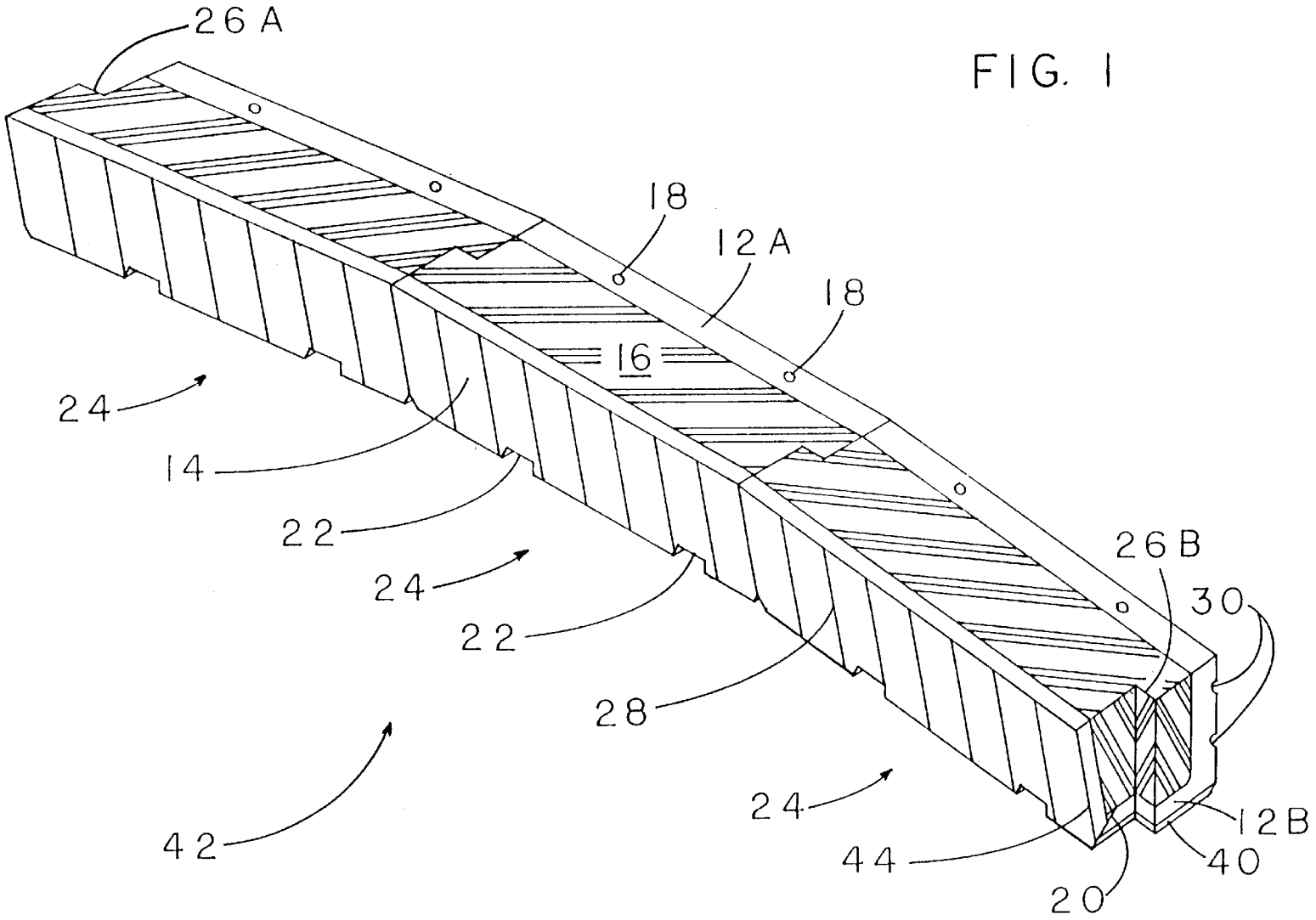
FIG. 1 is an isometric frontal view showing a plurality of barriers forming an energy absorbing barrier system.

| | | | |
|---|---|---|---|
| 12A | Back | 28 | Reticulated Finish |
| 12B | Back Support | 30 | Cable Trays |
| 14 | Concrete Veneer Face | 32 | Backing Cable Typical |
| 16 | Center Core | 34 | Cable Retaining Plates |
| 18 | Support Holes | 36 | Bolts Typical |
| 20 | Shear Point | 38 | Threaded Inserts |
| 22 | Transverse Slot | 40 | Chamfer |
| 24 | Barrier | 42 | Energy Absorbing Barrier System |
| 26A | Upstanding Lap Joint | 44 | Obtuse Angle |
| 26B | Upstanding Lap Joint | | |

SUMMARY OF INVENTION

Briefly in this invention a energy absorbing barrier system comprises a plurality of composite concrete barrier units each of which has a concrete base of sufficient size for it to be free standing; an upstanding lap joint at each respective end, and two transverse drainage slots. On the back side of the barrier are several horizontal slots cast into the barrier to hold several cables that aid in alignment and distribution of impact loads. The cables, if needed, are held in place by several removable steel plates. Two holes on the top side of a barrier unit are arranged to have equal spacing in regard to other units. The holes extending the full height of a unit can be used to support debris fencing, sign posts, lights, and the like.

DETAILED DESCRIPTION OF PREFERRED EMBODIMENT

In this embodiment a energy absorbing barrier system 42 comprises a plurality of composite concrete barriers each having a substantially L-shaped concrete back 12A and support base 12B reinforced with welded wire fabric or polypropylene fiber or reinforcing steel or any combination thereof, a concrete veneer face 14, and a center core 16. Back 12A has a plurality of holes 18 being of a minimum of 1½" diameter extending the full height of barrier 24 and arranged to have equal spacing in regard to adjacent barriers 24. A center core 16 is made of a light density material having a maximum density of thirty pounds per cubic foot, such as polyurethane or polystyrene but not limited thereto. A concrete veneer face 14 sloping up and away gently from the back 12A thus creating a wider top than support base 12B resulting in a obtuse angle 44 which enhances the deflection of sound and debris back onto the track. Face 14 is made of a thin layer of concrete, preferably using a standard concrete or a maximum size of ⅜" diameter per gravel aggregate mix reinforced by polypropylene fiber or a non-metallic mesh, such polyethylene mesh, having a maximum web spacing of approximately 4". Face 14 has a reticulated type finish 28 which enables face 14 to break inwards more readily thus adding time to duration of a crash impact. At the juncture of face 14 and base 12B a shear point

20 is provided so face 14 can break away from base 12B and more evenly distribute impact load across center core 16.

It is important that the weight of each barrier 24 be a minimum of 425 pounds per running foot, so that barrier 24 be can be free standing without the need to anchor it down or penetrate the earth to retain its position.

Figure 1A:
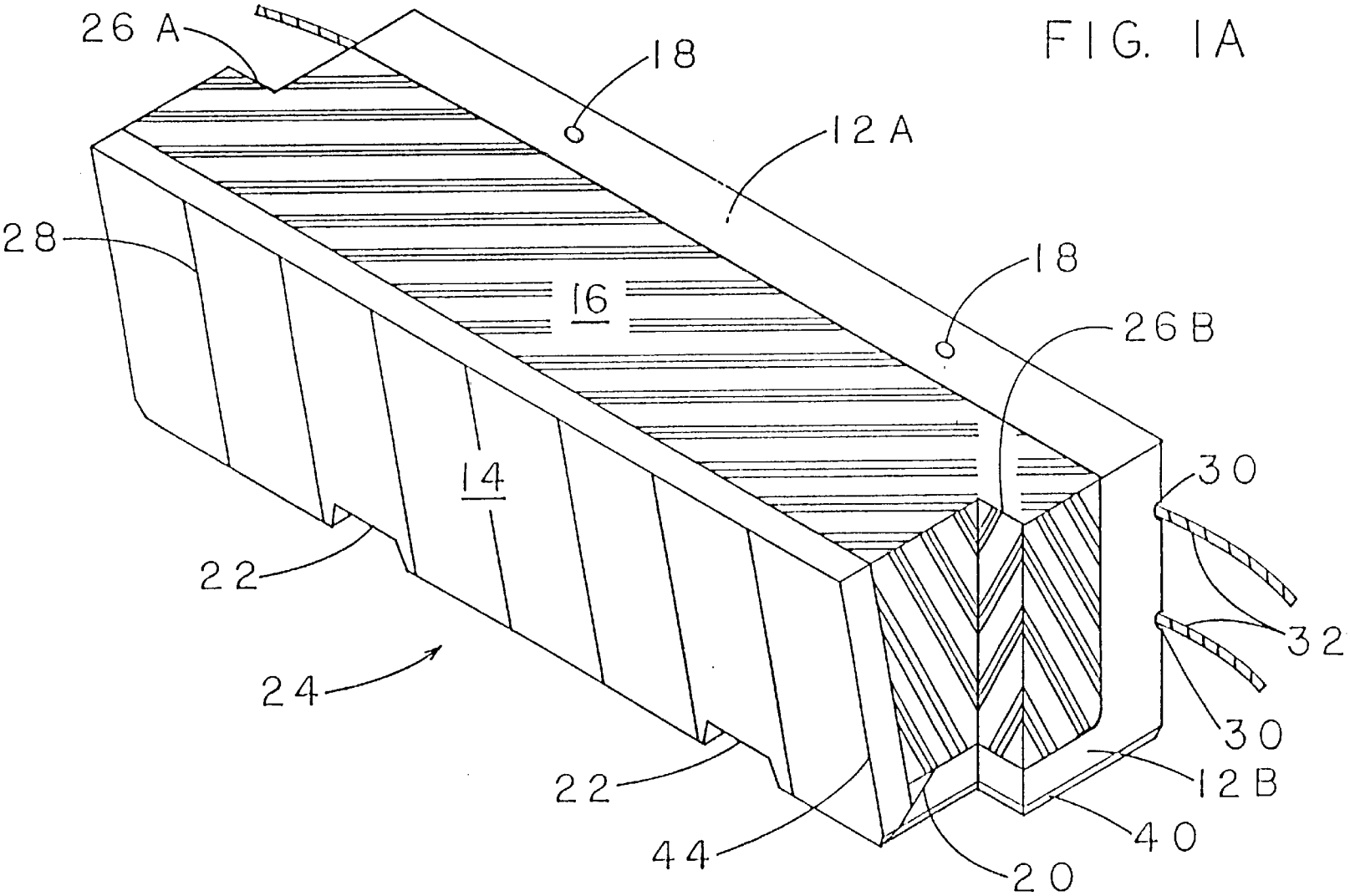
FIG. 1A is an isometric frontal view of a single barrier.

As seen in FIG. 1A, each barrier 24 is provided with a upstanding lap joint 26A and 26B at respective ends to aid in alignment along with a chamfer 40 to aid in placement and removal. Each barrier 24 has two transverse slots 22 so that a forklift type vehicle or crane can easily move barrier 24 to desired location. Each transverse slot 22 also acts as a means to prevent a backup of surface water.

Figure 2:
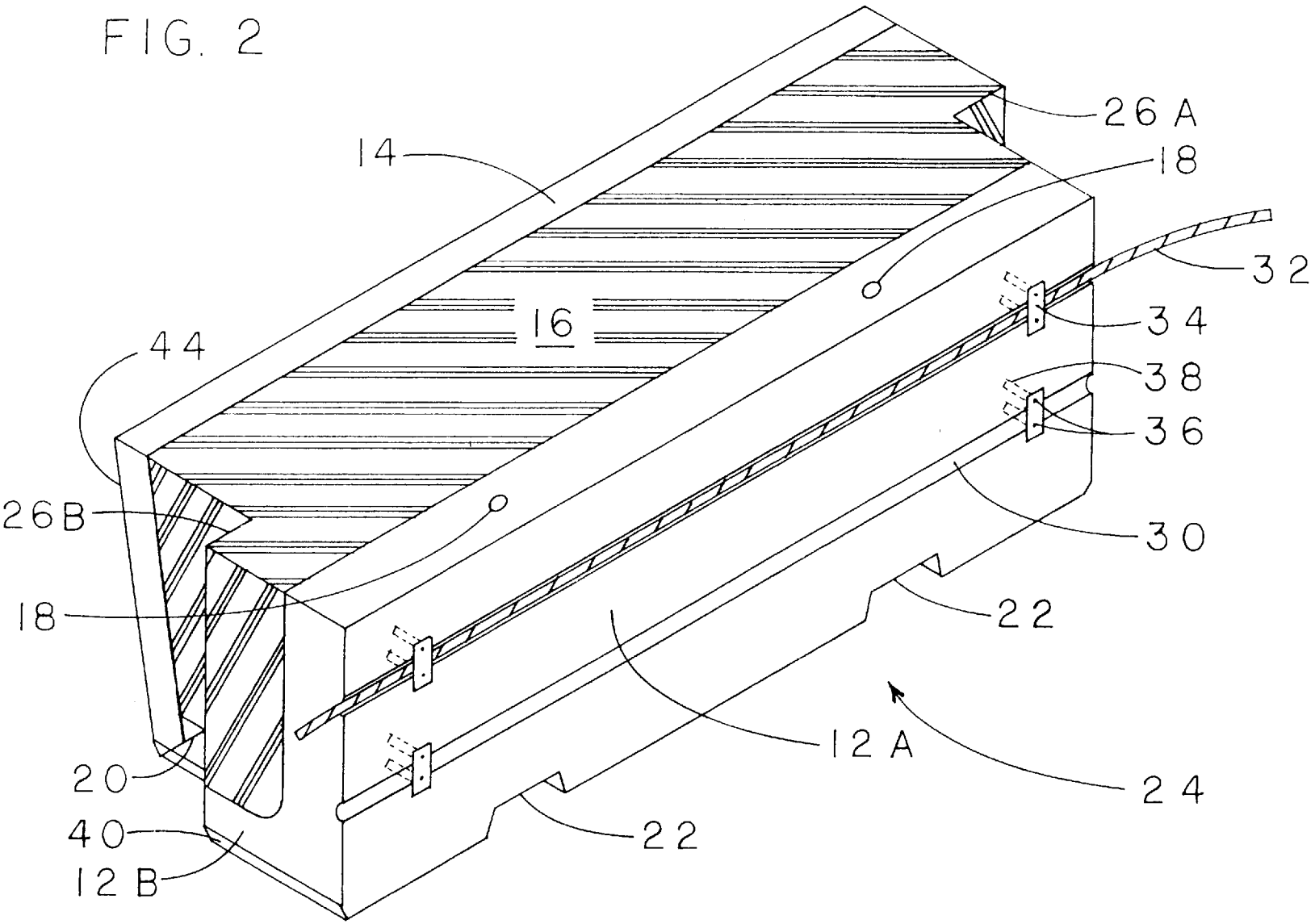
FIG. 2 is an isometric back view of a single barrier.

As seen best in FIG. 2, a plurality of cable trays 30 and threaded inserts 38 are formed into the concrete so that backing cable 32 can be held in place by a plurality of bolts 36 and cable retaining plates 34.

Accordingly, the reader will see that the energy absorbing barrier system of this invention can be used in many different configurations.

Though primarily designed for road course circuits, this in no way limits the use. Other applications such as drag racing tracks, highway construction zones, as barriers on particularly dangerous turns, as rock slide retention along highways, and on oval tracks. On tracks with existing permanent barriers walls, the units are simply put in front of existing walls which will negate the use of backing cables.

While my above description contains many specificities, these should not be construed as limitations on the scope of the invention, but rather as an exemplification of one preferred embodiment thereof Many other variations are possible. For example, the barrier units can be painted different colors to blend in with existing landscape or painted in bold colors for advertising purposes. A unit can be built as a singular turn unit in either a concave or convex shape towards the track. A unit can be configured to act as a starting or ending unit with the same energy absorbing capabilities.

Thus the scope of the invention should be determined by the appended claims and their legal equivalents, rather than by the examples given.

I claim:

1. An energy absorbing barrier capable of decelerating a high speed vehicle in an extended amount of time comprising a concrete section and a concrete veneer face section having an upper portion and a lower portion, said concrete section having a back wall upon a support base, said support base being connected to said face section, said face section being forwardly sloping from said support base to form an obtuse angle therewith wherein said upper portion of said face section extends at least partially over said lower portion of said face section, said back wall and said face section defining an intermediate center core section therebetween of a light density crushable material, said connection of said face section to said support base having a fracturable shear point to facilitate the collapsing in of said face section into said intermediate center core section.

2. The energy absorbing barrier of claim 1 wherein said concrete section is substantially L-shaped in cross section.

3. The energy absorbing barrier of claim 1 wherein said light density crushable material of said intermediate central core section is either polystyrene or polyurethane.

4. The energy absorbing barrier of claim 1 wherein said concrete section includes an upper surface having a plurality of holes sufficient to support an object placed therein.

5. The energy absorbing barrier of claim 1 wherein said concrete veneer face section is reticulated.

6. The energy absorbing barrier of claim 1 wherein said barrier is of a size sufficient to be free standing without the need to anchor it down or penetrate the earth to retain its position.

7. The energy absorbing barrier of claim 1 wherein said barrier is provided with an upstanding lap joint at each of its respective side ends to foster the placement and removal of a plurality of such barriers relative one another.

8. The energy absorbing barrier of claim 1 wherein said concrete section and said concrete veneer face includes at least one traverse slot.

9. The energy absorbing barrier of claim 1 wherein said back wall of said concrete section has an outwardly facing surface having at least one horizontal slot therein.

10. The energy absorbing barrier of claim 9 wherein said horizontal slot further includes a cable set therein.

11. An energy absorbing barrier system comprising a plurality of energy absorbing barriers as defined in claim 1, said plurality being joined with one another by means for joining said barriers end to end to form a continuous barrier system.

12. The energy absorbing barrier system of claim 11 wherein said means for joining said barriers end to end comprise a plurality of tie cables or cooperative upstanding lap joints.

* * * * *